US005601272A

United States Patent [19]

Adams et al.

[11] Patent Number: 5,601,272

[45] Date of Patent: Feb. 11, 1997

[54] CANDLE HOLDER

[75] Inventors: William E. Adams, Butler County, Pa.; William Raftery, Stark County, Ohio

[73] Assignee: Adams Mfg. Corp., Portersville, Pa.

[21] Appl. No.: 451,300

[22] Filed: May 26, 1995

Related U.S. Application Data

[63] Continuation-in-part of Ser. No. 101,738, Aug. 4, 1993, Pat. No. 5,419,527.

[51] Int. Cl.[6] ..... F23D 3/16

[52] U.S. Cl. ..... 248/518; 248/126; 248/539; 431/289; 431/297

[58] Field of Search ..... 248/518, 537, 248/539, 523, 126; 431/289, 295, 296, 297

[56] References Cited

U.S. PATENT DOCUMENTS

| | | | |
|---|---|---|---|
| D. 313,660 | 1/1991 | Adams | D26/9 |
| 832,134 | 10/1906 | Lechner | 431/297 |
| 849,012 | 11/1907 | Nehr | 431/289 |
| 924,741 | 6/1909 | Cooper | 431/296 |
| 1,128,884 | 2/1915 | Lind | 431/295 |
| 1,750,171 | 3/1930 | Goldstone | 431/295 |
| 1,831,518 | 11/1931 | Tebo | 431/295 |
| 2,300,226 | 10/1942 | Ketchum | 431/289 X |
| 2,508,933 | 5/1950 | Walker | 431/289 |
| 4,155,979 | 5/1979 | Powell | 431/296 X |

FOREIGN PATENT DOCUMENTS

| | | | |
|---|---|---|---|
| 100685 | 5/1937 | Australia | 431/296 |
| 15482 | 8/1906 | Norway | 431/289 |
| 3618 | of 1890 | United Kingdom | 431/289 |
| 22205 | of 1894 | United Kingdom | 431/297 |

*Primary Examiner*—Derek J. Berger

*Attorney, Agent, or Firm*—Buchanan Ingersoll; Lynn J. Alstadt

[57] ABSTRACT

A candle holder has a base, an upright attached to one edge of the base and a candle support extending from the upright over the base. Suction cups are provided on the upright for mounting. Feet near the suction cups prevent the holder from rocking. One of a series of figures which are preferably shaped as holiday symbols is fitted into the upright. The figures preferably are removable from the upright.

24 Claims, 12 Drawing Sheets

CANDLE HOLDER

RELATED APPLICATION

This application is a continuation-in-part of application, Ser. No. 08/101,738, filed Aug. 4, 1993, now U.S. Pat. No. 5,419,527.

BACKGROUND OF THE INVENTION

1. Field of the Invention

The invention relates to a device for holding candles against vertical surfaces such as a window.

2. Description of the Prior Art

For many years people have observed the custom of placing a lighted candle in one or more windows of their homes. The candle could be a conventional wax candle having a slow burning wick which is ignited. More commonly, however, the candle contains a light bulb which may be powered with a battery or by use of an electrical cord. Conventionally, these candles have been placed on a window sill or adjacent the window pane. However, in recent years homes, as well as other buildings, are being built with windows which have no window sill or very narrow window sills. Hence, there is a need for a holder which can be mounted on the window pane and support a candle adjacent the window pane.

When candles are placed on window sills they can easily be dislodged by pets, children or moving curtains. A lighted candle which has fallen onto a carpet or furniture may scorch or ignite the fabric. Hence, there is a need for a candle holder from which candles cannot be easily dislodged.

It has also been customary to decorate windows with various types of figures associated with a particular holiday season. Angels, bells, Santa Claus and wreath figures are common Christmas decorations. Pumpkins, ghosts and witches are used at Halloween. Turkeys and pilgrims are symbols of Thanksgiving. For Valentine's Day there is the heart and cupid. For the July 4th, the American flag, stars and firecrackers are commonly seen. Although many holiday decorations are illuminated with electric lights, none of these decorations have been incorporated into a candle holder so as to utilize the light produced from a candle placed on the holder. Similarly the art has not developed a candle holder or decoration having interchangeable figures which can be used for a variety of holiday seasons by simply changing the figure attached to the candle holder. Hence, there is no one decoration which can be used throughout the year or at least throughout the major holiday season running from Halloween to New Year's Day.

SUMMARY OF THE INVENTION

We provide a candle holder having a base and upright extending from the base and a candle support extending from the upright over the base. In one embodiment the upright has at least one slot or aperture on which a suction cup can be mounted for attaching the holder to a window pane or other vertical surface. A guide edge is provided on the perimeter of the upright. The guide edge has a cross section which will enable a slotted figure to be fitted over the upright and there be retained against transverse movement. Preferably the upright and the figure are translucent so that an illuminated candle placed on the holder will illuminate, and preferably accentuate, a figure placed on the upright. The surface of the figure can be molded or inscribed to have patterns that transmit or reflect light. The figure can be removed by simply lifting it vertically from the upright. We prefer to provide a variety of figures each having a shape which is associated with a holiday. Thus, the candle holder can remain in place through many seasons with the figure being changed as the holidays change.

A second preferred embodiment is similar to the first except that suction cups are attached to the removable figure. In this embodiment means are provided to lock the figure in place on the upright.

In a third preferred embodiment present embodiment the upright is shaped as a seasonal or other figure.

In another preferred embodiment, the perimeter of the upright has a cross section which will enable a slotted figure to be fitted over the upright. The slotted figure has a tongue extending generally longitudinally into the slot and at least one notch parallel to the slot in the lower portion of the figure. The candle support has an opening sized to accept the tongue, and the base includes at least one pedestal having at least one groove sized and positioned to mate with the notch of the figure. The groove and the notch, and the opening and the tongue, cooperate so that the figure can be retained in the candle holder against transverse movement.

We prefer to provide at least two legs or a bar extending from the upright away from the base. These provide important support and stability to prevent the holder from rocking sideways about the suction cup which mounts it to the vertical surface.

We further prefer to provide a retainer on an edge of the base opposite the upright to prevent a candle placed on the base from sliding off of the base. In one embodiment we provide interlocking arms or a wire tie to hold the candle on the base. We also may provide a pad on the base onto which the candle can be placed.

Other objects and advantages of the invention will be apparent as a description of certain present preferred embodiments shown in the figures proceeds.

DETAILED DESCRIPTION OF THE PREFERRED EMBODIMENTS

Figure 1:
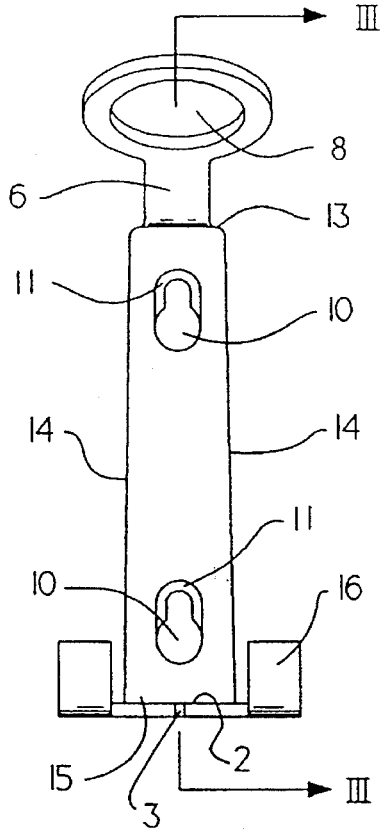
FIG. 1 is a front view of a first present preferred embodiment our candle holder.
Figure 3:
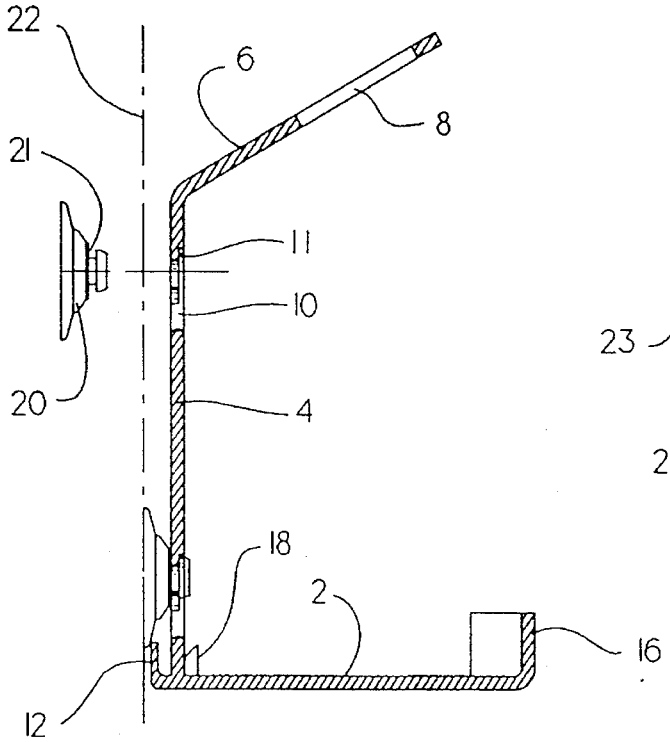
FIG. 3 is a sectional view taken along the line III—III of FIG. 1.
Figure 4:
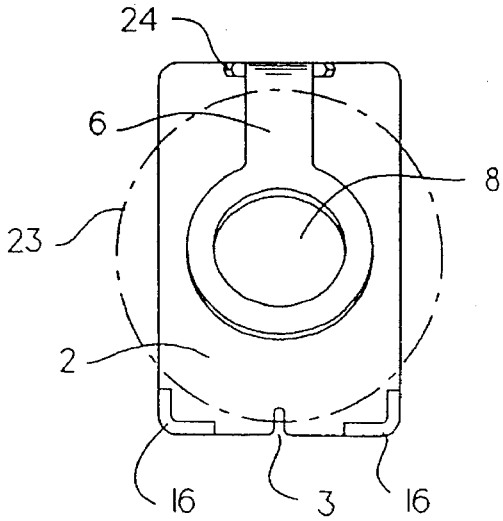
FIG. 4 is a top plan view of a second preferred embodiment of our candle holder.

As shown in FIGS. 1 and 3, a first preferred embodiment of our candle holder is comprised generally of a base 2 having an upright 4 extending from the base. A candle support 6 extends from the upright over the base. The base, upright and candle support may be molded separately and welded, glued or snap fit together. Alternatively, they could be molded together as in the embodiment of FIG. 17. The candle support 6 has an aperture 8 through which a candle can fit. Although the aperture in the drawings is circular, it could be oval or any other configuration, including gripping arms. Apertures 10, preferably having a beveled edge 11, are provided in the upright. Each aperture is sized to receive a neck 21 of suction cup 20 which is fitted into the aperture 10. The suction cups are used to mount the candle holder on a vertical surface such as a window pane indicated by chainline 22 in FIG. 3. They could also be attached to the upright by screws or other fasteners. We prefer to provide two feet 12 at either corner of base. However, a single foot extending across the base is also suitable. One could also place the feet at other locations along the upright. When the candle holder is pressed against the window pane 22, feet 12 will abut the window pane. These feet are sized and positioned to prevent the candle holder from being rocked against the window pane. This stability makes the suction cup hold longer. Without this stability, movement encourages a "pumping" action working air underneath the cup which will ultimately cause the cup to release. The legs also serve as a guide for assuring that proper compression of the suction cup is obtained when the candle holder is mounted on a window pane. We prefer to provide a retainer 16 at either corner of the base 2 to prevent a candle placed on the base from sliding off. We also prefer to provide a cord slot 3 in the base. An electric candle placed on the base 2 as indicated by chainline 23 in FIG. 4 can be positioned so that the cord extending from the candle fits securely in slot 3. A guide edge 14 on the upright 4 will engage a removable figure such as is shown in FIGS. 6, 7, 12 and 13. The guide edge is preferably tapered from a minor width at the top 13 of the upright to a wider width at the bottom 15 of the upright. As shown in the embodiment of FIG. 4 we prefer that the guide edge 14 have a locking surface. This locking surface could be a double beveled edge 24 shown in FIG. 4. One could also use a tongue and groove arrangement or other shape which enables the guide edge to meet and lock with a mating edge provided in a figure placed over the upright.

In FIGS. 5 thru 8 we show yet another embodiment of our candle holder generally identified as 30. In this embodiment we provide a base 32 and upright 34 which has a beveled edge 35. As in the previous embodiment an aperture 4 is provided in the upright for receipt of the neck of a suction cup. A candle support 36 extends from the top of the upright 34. As in the previous embodiment we prefer to provide a retainer 37 at the outer edge of the base. We also prefer to provide a pad on the base onto which a candle will be placed. This pad could be a resilient material such as polyurethane or an adhesive layer or tape which creates greater adhesion or friction between a candle placed on the base and the base thereby lessening the chance that a candle will be dislodged from the holder. An angel figure 40 has a slot 44 which is sized to accommodate the upright 34 of the candle holder 30. The slot in angel 44 has a beveled mating surface 45 which engages beveled edge 35 of upright 34. The angel is preferably made of a transparent or translucent material so that light emitted from the candle placed on the candle holder will pass through the angel and illuminate it.

We prefer to mold the figure to have relatively thin bodies with ribs on the side which faces the candle. The ribs may serve a dual function. First, they provide reinforcement. Hence, any stress on the figure which occurs as it is being placed on the holder will spread throughout the figure. Also, stress from the holder is spread to resist cracking and crazing at stress points which is common to thin plastic articles exposed to the sun. The ribs also prevent warping and do not cause unsightly shrinking in the finished part. A second function of the ribs is to act as light pumps. The ribs can be sized and positioned relative to the candle to gather and focus light on desired areas. For example, we prefer to provide ribs 41 on the angel shown in FIG. 7. These ribs outline the figure making it easily recognizable from the street. If desired the figure 40 may be angled or contoured to partially encircle the candle to get more light on the figure and the ribs.

Figure 6:
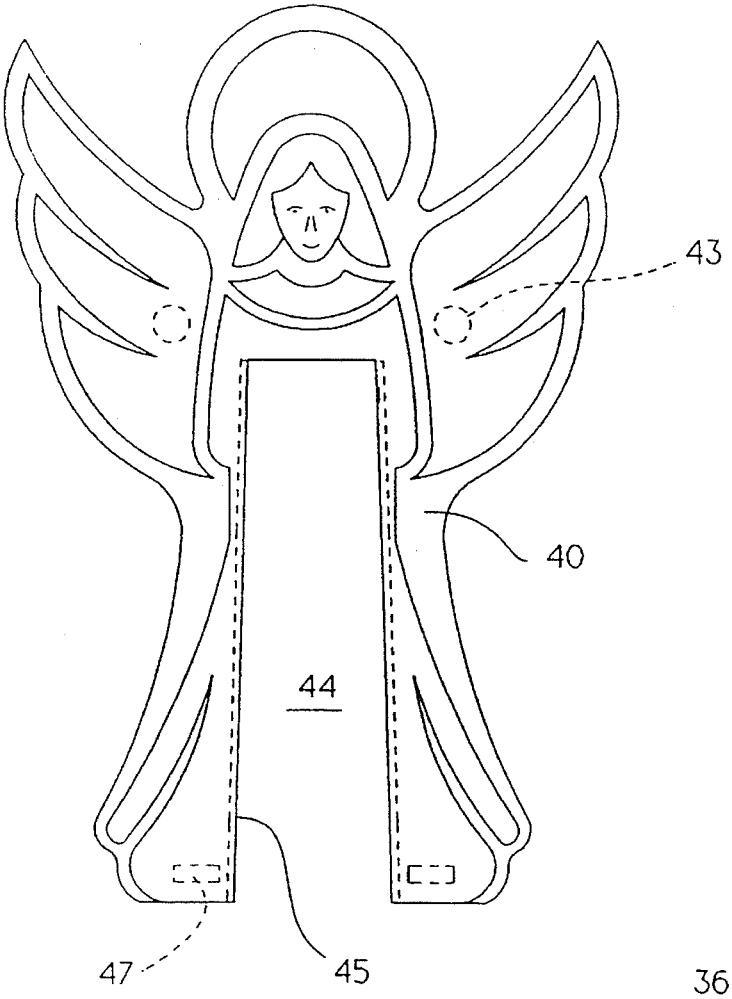
FIG. 6 is a front view of an angel figure sized to be placed on the candle holder of FIG. 5.
Figure 5:
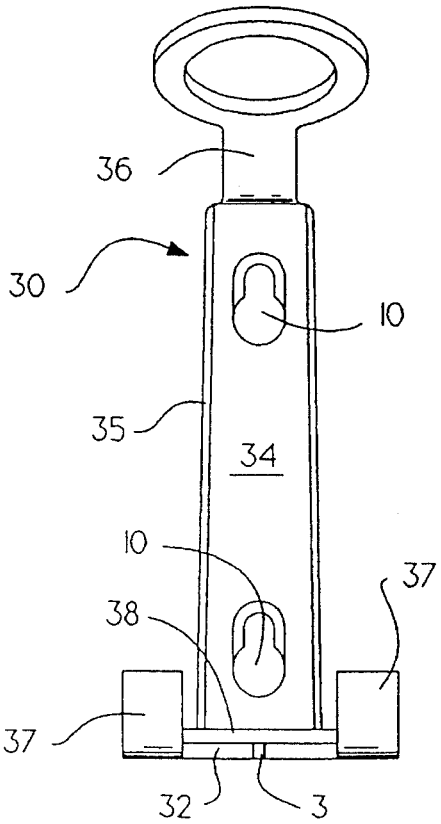
FIG. 5 is a front view of a third present preferred embodiment of our candle holder.
Figure 11:
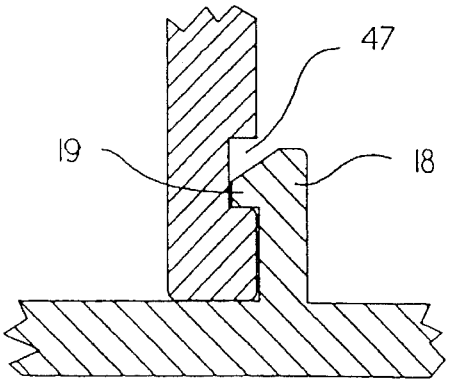
FIG. 11 is a detail showing the interlocking feature of the embodiment of FIG. 10.
Figure 7:
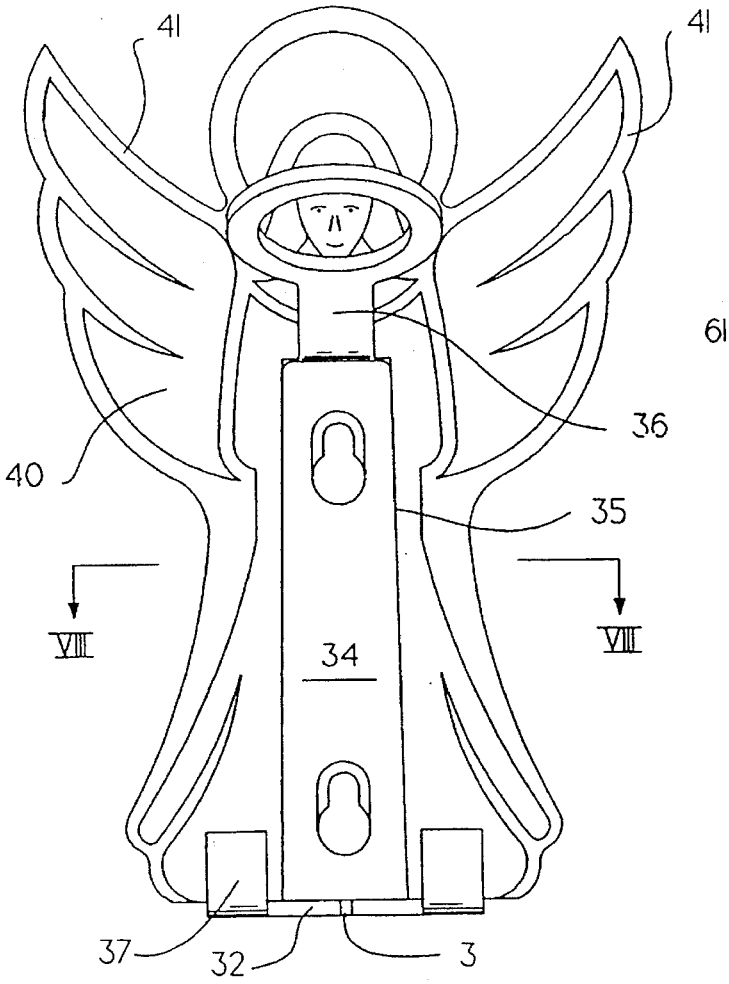
FIG. 7 is a front view of the candle holder of FIG. 5 with the angel of FIG. 6 mounted thereon.
Figure 9:
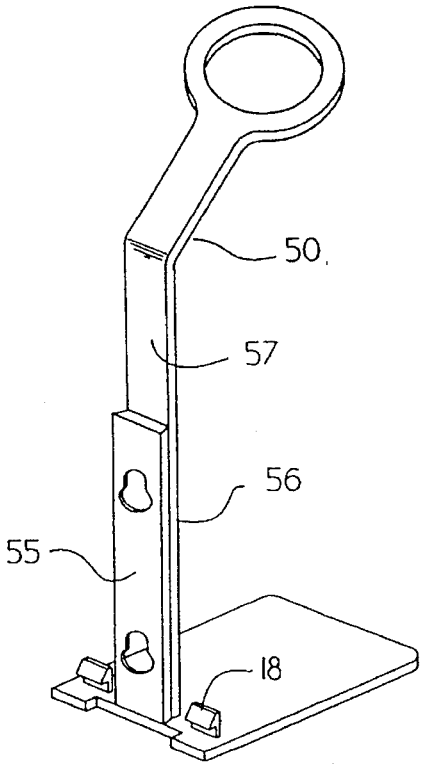
FIG. 9 is a front view of a third preferred embodiment of our candle holder.
Figure 8:
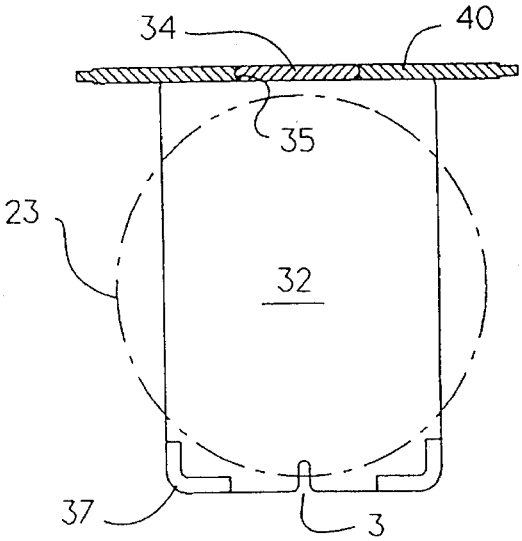
FIG. 8 is a sectional view taken along the line VIII—VIII of FIG. 7.

The angel figure of FIGS. 6 and 7 can optionally be provided with recesses 47 and tabs 48 having projections 49 can be provided on the base. As shown in FIG. 11 the projections 49 will mate with recesses 47 to lock the angel in place. In the embodiment of FIG. 9 we have locking tabs 18 positioned on the base near upright 56 which has a lower portion 55 and upper portion 57.

One could also attach suction cups to the figure as indicated by the dotted circles 43 in FIG. 6. These suction cups can be used in place of or in addition to the suction cups connected to the upright 34 at apertures 4.

Figure 10:
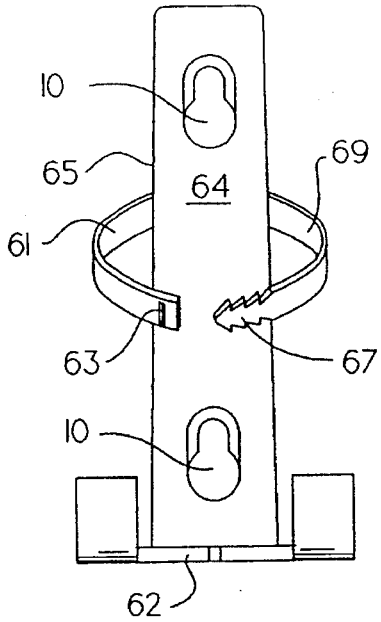
FIG. 10 is a perspective view of a fourth present preferred embodiment of our candle holder.

Yet another embodiment of our candle holder 60 is shown in FIG. 10. There we provide a base 62 having an upright 64 extending therefrom. Apertures 4 are provided in the upright. The upright has a mating surface 65 which engages a mating edge such as edge 45 of the angel 40 shown in FIG. 6. In this embodiment the candle support is comprised to two arms 61 and 69. The distal ends of these arms are configured so that the arms can be interlocked. In this particular embodiment a slot 63 is provided in arm 61. A series of projections 67 is provided at the distal end of arm 62. Hence, the end of arm 69 can be threaded through the slot 63 in arm 61 and the projections 67 will cause the arms to remain interlocked. One could use other fasteners to connect the ends of arms 61 and 69.

Figure 12:
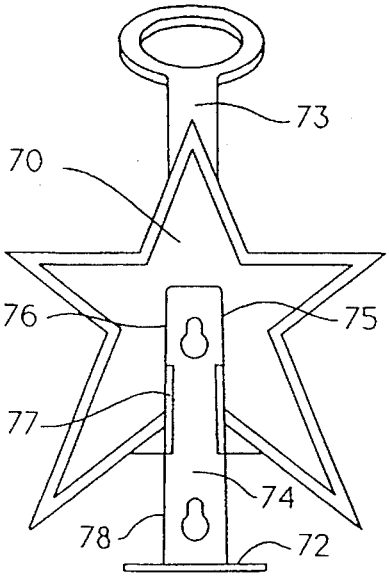
FIG. 12 is a rear view of a fourth present preferred embodiment of our candle holder with a star figure.

In FIG. 12 we show yet another embodiment of our candle holder. Here a star figure 70 is fitted over upright 74 which extends from base 72. It should be noted that the star does not extend to the base 72 when in its mounted position. Furthermore, in this embodiment we provide a guiding edge 75 which has portions 76, 77 and 78 that a alternately beveled toward and away from the candle holder 73 which extends over the base. This configuration will receive a beveled edge provided on the slot in the star figure 70.

Figure 13:
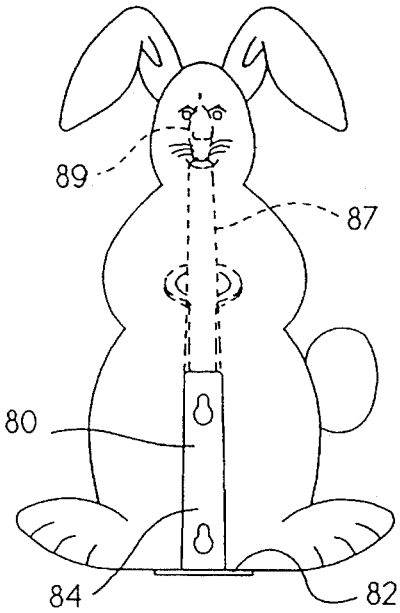
FIG. 13 is a fifth present preferred embodiment of our candle holder with an easter bunny figure.

A candle holder 80 having an Easter bunny figure mounted thereon is shown in FIG. 13. As shown in the previous embodiments the Easter bunny figure has a slot into which candle upright 84 is fitted. In this embodiment, however, the figure is sized so that a candle indicated by chainline 87 which is placed on base 82 will not extend above the figure. Preferably, the illuminated portion 89 of the candle will be behind the bunny's face.

Figure 2:
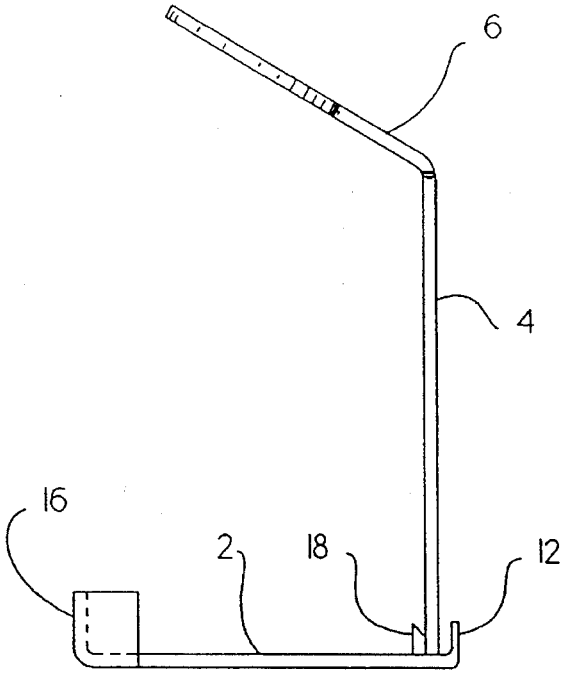
FIG. 2 is a side view of the embodiment of FIG. 1.
Figure 14:
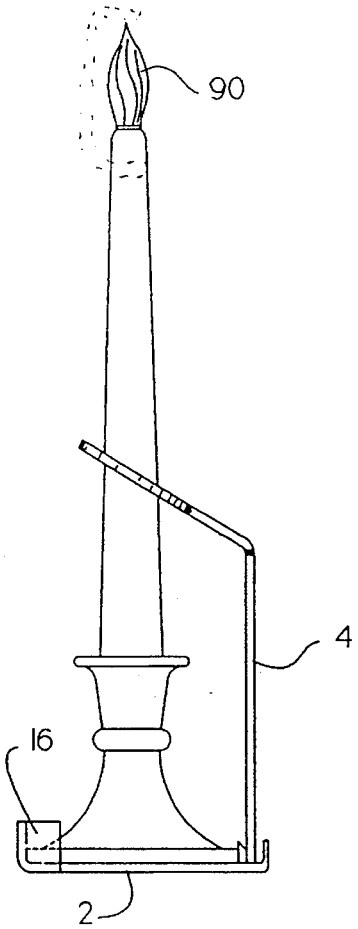
FIG. 14 is a side view of the embodiment of FIG. 1 with a candle placed therein.
Figure 15:
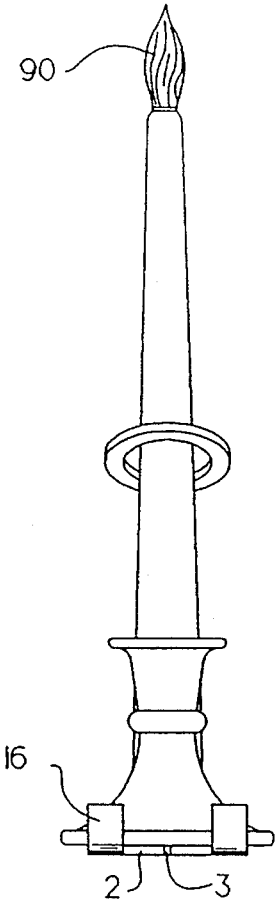
FIG. 15 is a front view of the embodiment of FIG. 14.
Figure 16:
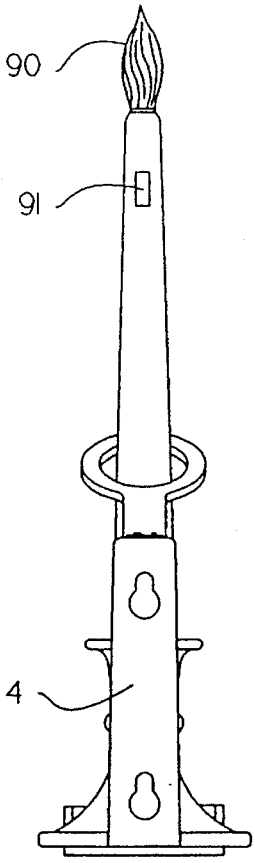
FIG. 16 is a rear view of the embodiment of FIGS. 14 and 15.

In FIGS. 14 thru 16 we illustrate generally how a candle can be placed in our candle holder using the embodiment shown in FIGS. 1 thru 3. Conventionally, the base of such candles is three inches in diameter. Therefore, we prefer that our base extend at least three inches from the upright portion 4 to the retainer 16. The candle preferably is an electric or battery powered candle having a light bulb 90. The candle may have a light sensitive switch 91 which activates the candle. If desired, a shield shown in chain line in FIG. 14 can be fitted over the candle as is done for night lights. The shield could be attached to the figure rather than the candle, if desired.

While we illustrated a single candle on our candle holder, the device can hold sets having 3, 5 or 7 candles on a single base. Some plant arrangements having a candle or upright which can be held by the candle support may also be placed on our candle holder.

Figure 18:
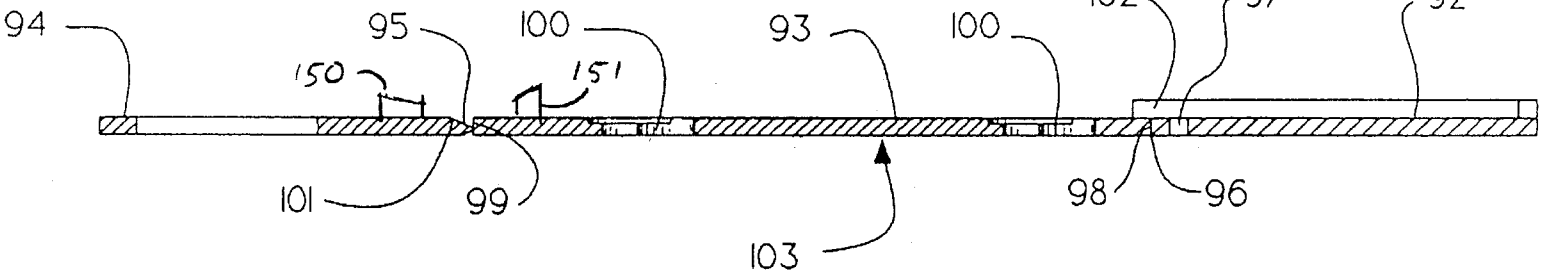
FIG. 18 is a sectional view taken along the line XVIII—XVIII of FIG. 17.
Figure 17:
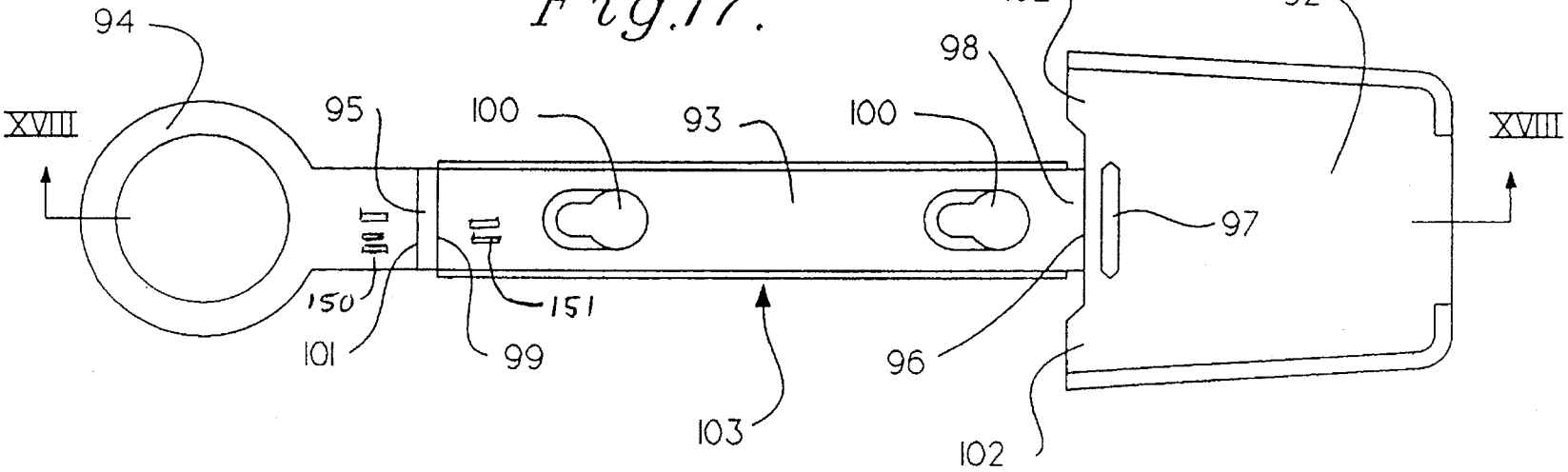
FIG. 17 is a top view of the sixth present preferred embodiment of our candle holder.
Figure 20:
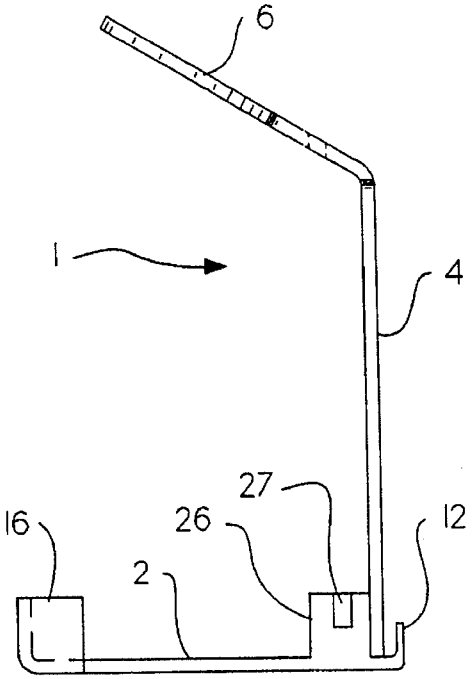
FIG. 20 is a side view of the embodiment of FIG. 19.
Figure 19:
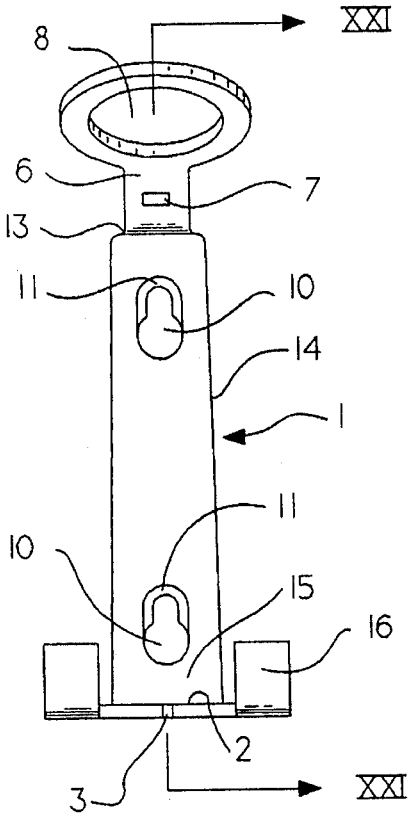
FIG. 19 is a front view of a seventh present preferred embodiment our candle holder.
Figure 21:
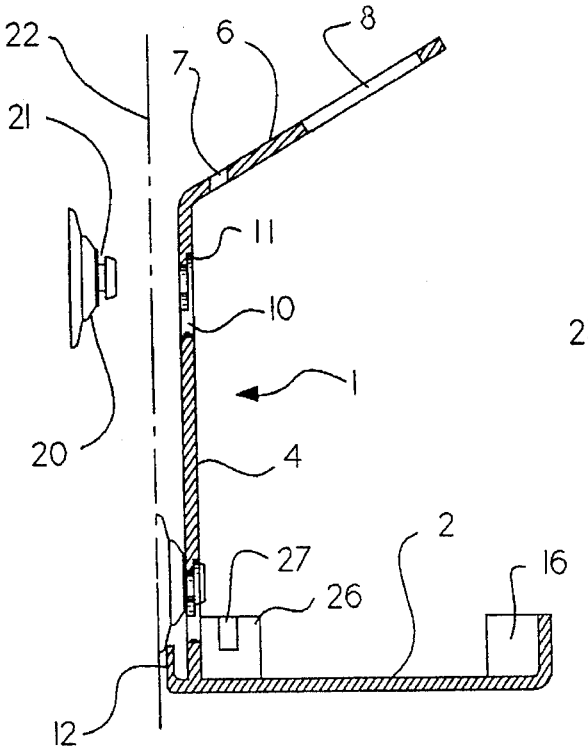
FIG. 21 is a sectional view taken along the line XXI—XXI of FIG. 19.
Figure 22:
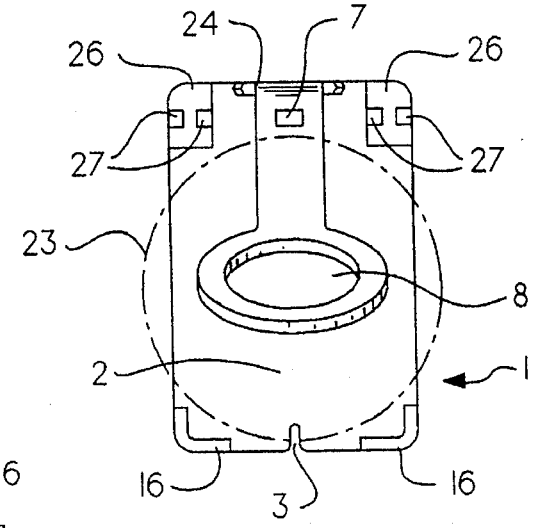
FIG. 22 is a top plan view of the embodiment of FIG. 19.

In FIGS. 17 and 18 we show yet another embodiment of our candle holder 103. In this embodiment we provide base 92, upright 93 and candle support 94, which are formed as a unitary structure. We also provide a folding notch 95 interposed between upright 93 and candle support 94. The notch 95 is formed by the beveled surfaces of candle support bottom edge 101 and upright top edge 99. When candle support 94 is folded along notch 95, edge 99 and edge 101 abut so that a candle can be aligned substantially parallel with upright 93. We also provide on upright 93 apertures 100 into which suction cups may be fitted.

In addition, one could provide for removable attachment of support 94 to holder 103, so that support 94 later can be reattached to holder 103 and aligned with upright 93 by the user. One could also provide for support 94 to be pivotably attached to holder 103, allowing the user to later align support 94 with upright 93.

We prefer to provide in this embodiment a separation score line 96 to facilitate separation of base 92 from candle holder 103. In this particular embodiment, a slot 97 is provided in base 92 so that after base 92 is separated from upright 93, edge 98 of upright 93 can be inserted into slot 97. One could provide a snap fit or glue this joint. One could also use a tongue and groove arrangement, a hinge arrangement or other shapes at separation score line 96 which enable upright 93 to engage and lock with base 92. Because this embodiment can be packed in a flat condition and assembled by the user, units can be packaged and displayed in any given container or display.

We further prefer to provide a set of mating projections 150 and 151. When support 94 is folded toward upright 93, projections 151 fit between projections 150 locking the support 94 in place. The projections are sized and positioned to assure that support 94 is locked at the proper angle relative to the upright 93.

We also prefer to provide support feet 102 extending across base 92. Feet 102 inhibit horizontal and vertical rocking movements thus providing a stabilizing effect similar to that afforded by feet 12 illustrated in FIGS. 2 and 3.

Our candle holder can be made of a variety of materials. We prefer to make the candle holder of polycarbonate, polyvinyl chloride, polypropylene, or styrene. We have made the candle holder using "K-RESIN" polypropylene. Certain light illuminating plastics may be used for the upright and the figures. We further prefer that the candle holder be injection molded as a single piece as indicated by the embodiment of FIGS. 17 and 18. However, as indicated by the embodiment of FIG. 9, the upright and base could be molded as one part whereas the candle holder could be a separate part which is glued, welded or friction fitted to the upright.

Even though we have shown the removable figures as holiday symbols, they may be otherwise shaped and may contain words or other indicia. For example one may provide a set of rectangular signs having price or other information. The signs could be used to advertise sales or other specials.

Even though we have shown a figure removably engaged with the guide edge on the upright, such as shown in FIGS. 6, 7, 12 and 13, such a figure instead could be permanently affixed to the upright. Alternatively, one could mold the upright in the form of a seasonal figure or other desired shape.

A seventh preferred embodiment utilizes an alternative means of holding the figure to the candle holder and is shown in FIGS. 19–23. As shown FIGS. 19 through 22, we prefer to provide in candle support 6 an opening 7 sized to receive a tongue from a figure, such as tongue 42 of angel figure 40 in FIG. 23. We prefer to provide on base 2 at least one pedestal 26 having at least one groove 27 adapted to matably receive a notch on a lower portion of the figure, such as notch 43 on angel figure 40 in FIG. 23. Although groove 27 can be disposed on one or both sides of pedestal 26, transverse to the base, groove 27 can extend transversely across the upper portion of pedestal 26.

Figure 23:
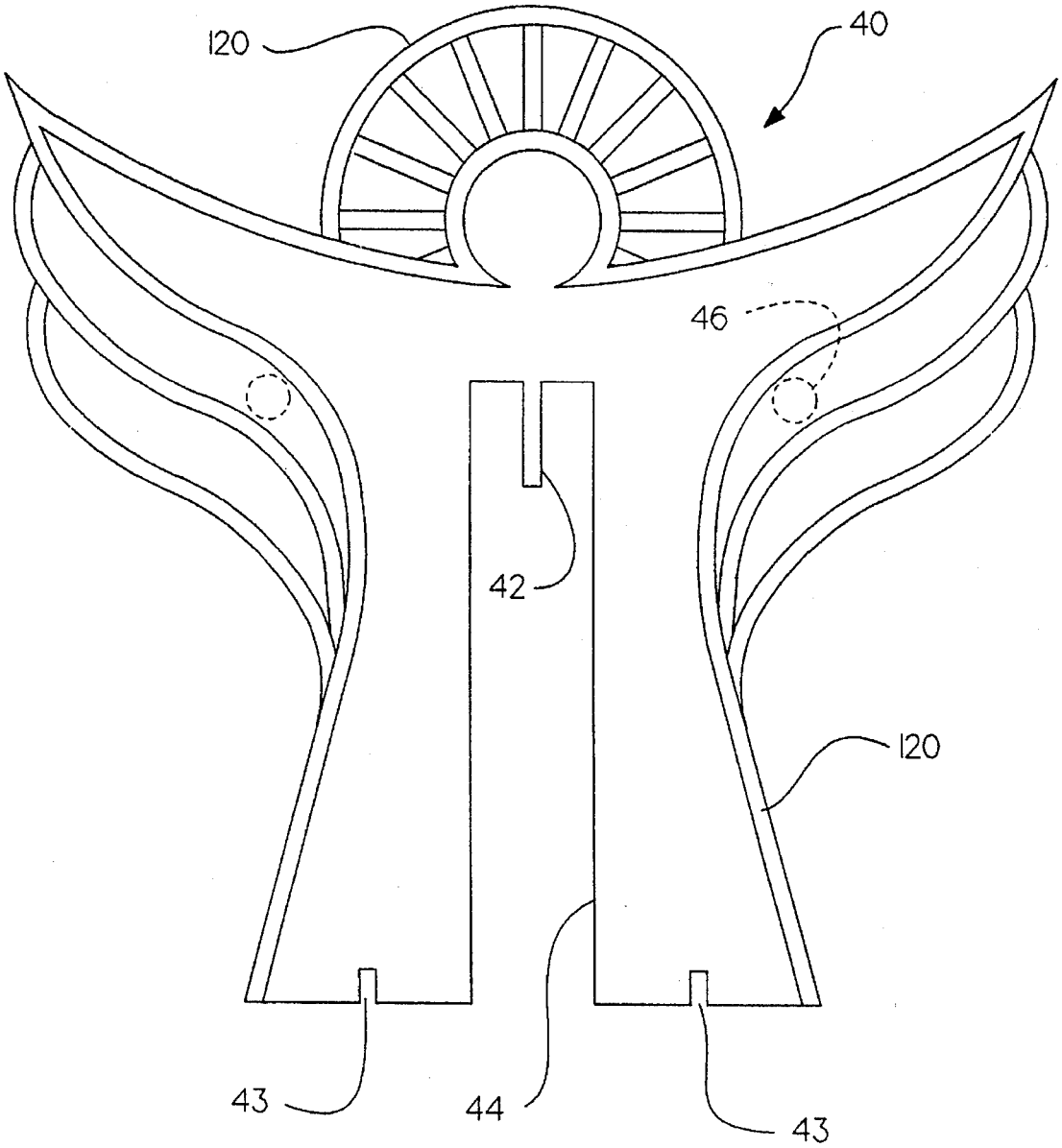
FIG. 23 is a front view of an angel figure sized to be placed on the candle holder of FIGS. 19–22.

In FIG. 23, an angel figure 40 has a slot 44 which is sized to accommodate the upright 4 of candle holder 1 in FIGS. 19–22. Angel 40 has a tongue 42 extending longitudinally in slot 44. Tongue 42 is sized and positioned to engage an opening such as opening 7 in support 6 shown in FIGS. 19–22. Also, the lower portion of angel 40 can have at least one notch 43 adapted to mate with groove 19 on pedestal 18, seen in FIGS. 20–22. When groove 27 extends transversely across the upper portion of pedestal 26, notch 43 is unnecessary.

The angel is preferably made of a transparent or translucent material so that light emitted from the candle placed on candle holder 1 will pass through the angel and illuminate it. The outer edge 120 of figure 40 can be roughened and tapered such that the light internally reflected in the material of the figure is concentrated at edge 120 providing a peripheral rim of light around figure 40. One could also attach suction cups to figure 40 as indicated by dotted circles 46. These suction cups can be used in place of or in addition to suction cups 20 connected to upright 4 at apertures 10 in FIG. 21.

Figure 24:
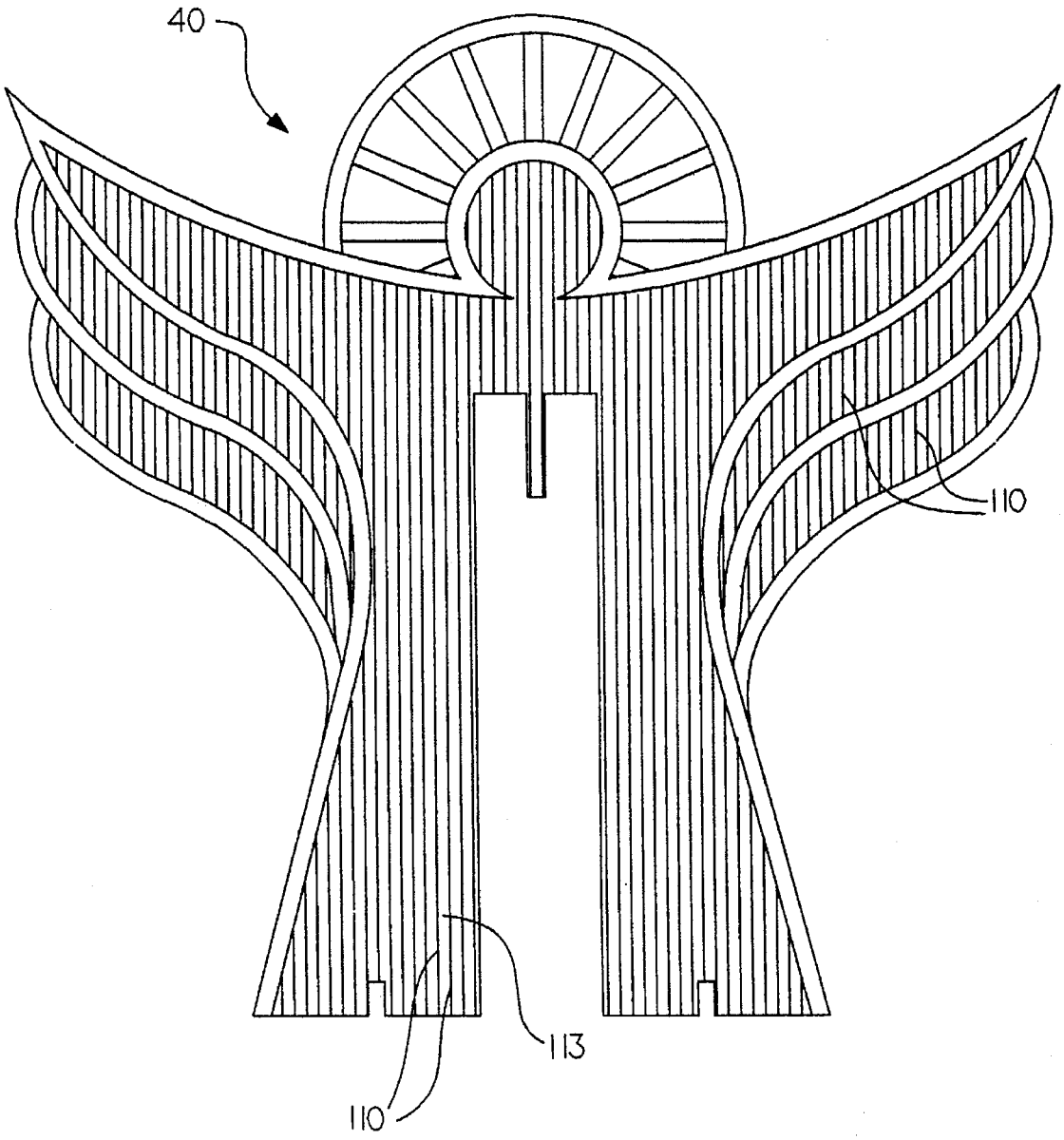
FIG. 24 is a front view of another embodiment of an angel figure having vertical grooves.

In yet another embodiment of the present invention, shown in FIG. 24, a plurality of vertical grooves 110 are provided on surface 113 of ornamental figure 40 which may be the obverse or the reverse side. A moire-like pattern can be made to appear on the surface of figure 40 by orienting grooves 110 at a small angle, e.g., 4° or more, with respect to the normal of surface 113 of the figure.

Figure 25:
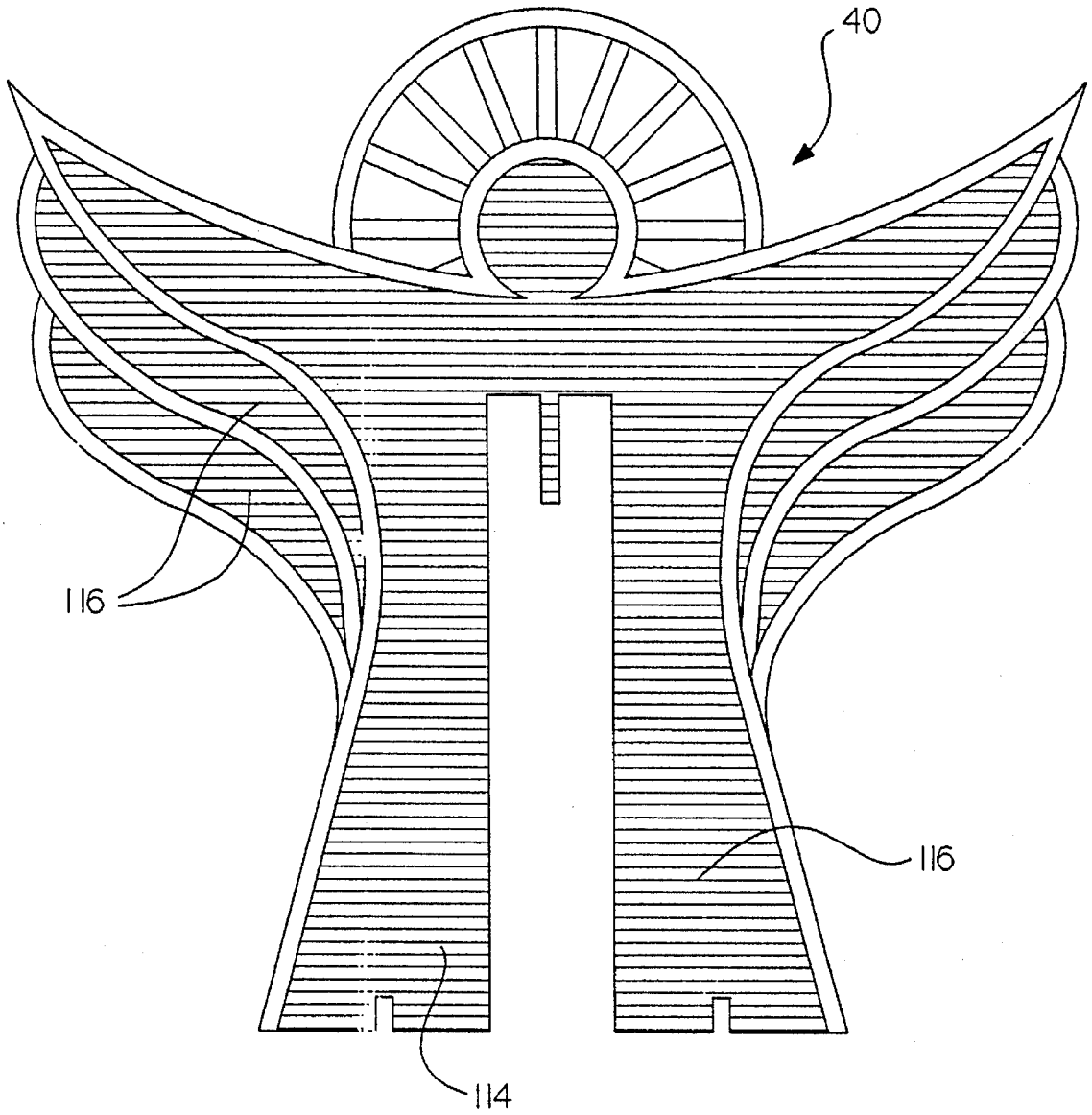
FIG. 25 is a front view of another embodiment of an angel figure having a coating and horizontal lineations.

In an additional embodiment, shown in FIG. 25, the surface 114 of figure 40 was treated with a coating 115 of light defracting material. Also, provided is a plurality of lineations 116 having a predefined angle of incidence respective of the normal of surface 114. This surface induces a prismatic lighting effect on light from the candle which impinges on figure 40 causing a variety of colors to appear on the figure. This effect can be used to enhance the decorative presentation of a single candle light. Lineations 116 can be, for example, grooves or ribs sized and shaped to defract the light from the candle. Similar grooves on the other side would cause attractive patterns from outside light. Microgrooves may be molded by specific injection techniques, such as injection-compression molding and by using special, high-flow materials that will accurately fill these tiny, C–D disc sized grooves.

Figure 26:
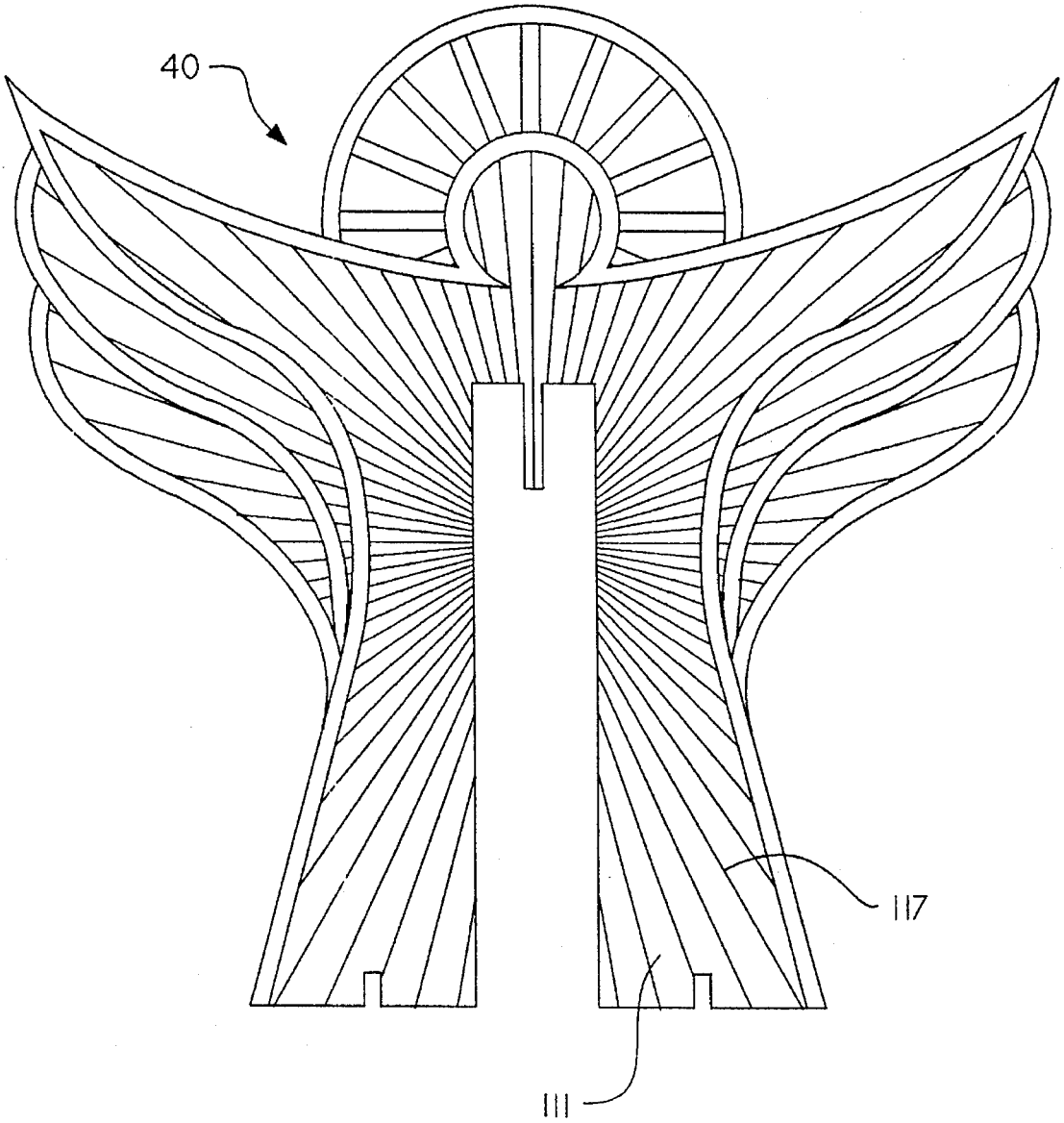
FIG. 26 is a front view of another embodiment of an angel figure having radially-extending lineations.

In another embodiment of the present invention, shown in FIG. 26, radially-extending lineations 117 are formed upon surface 111 of figure 40. The lineations radiate from a region that is adjacent to the light bulb of a candle placed next to the figure. Then the candle light can be directed to illuminate outer edge 112 of figure 40. Lineations 117 can be, for example, grooves or ribs.

Where the figure is grooved to provide the aforementioned optical effects, such as, for example, grooves 110 in FIG. 24, the depth or breadth of grooves 110 can be tapered towards the center of figure 40, with the broader or deeper dimension of grooves 110 being disposed towards the center. A similar effect can be created by tapering the thickness or breadth of other lineations, such as ribs. The tapered lineations can reduce the brightness of the candle light passing through figure 40 in the immediate vicinity of the light source.

Figure 27:
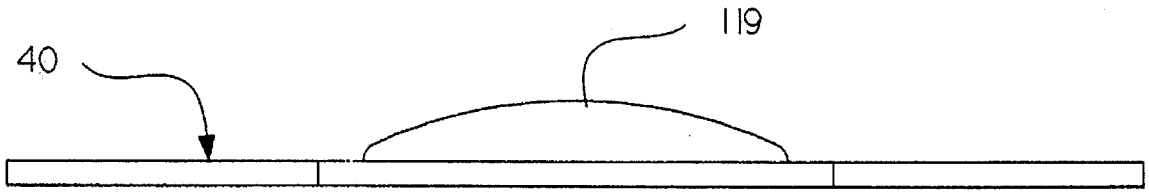
FIG. 27 is a top view of an angel figure similar to that in FIG. 23.

A top view in yet another embodiment of the present invention similar to the angel of FIG. 23 is shown in FIG. 27. In this embodiment, additional optical effects are produced by providing on surface 118 of figure 40, lens 119 at approximately the level of the candle light. Lens 119 may be a convex lens on surface 118, as shown, or it may be a concave lens. A convex lens may be used to enlarge the appearance of the candle light emanating from behind figure 40 whereas a concave lens may be used to reduce the appearance of the candle light. Although lens 119 can be an entity separate from and attached to surface 118, it is preferred to integrally mold lens 119 into surface 118.

Figure 28:
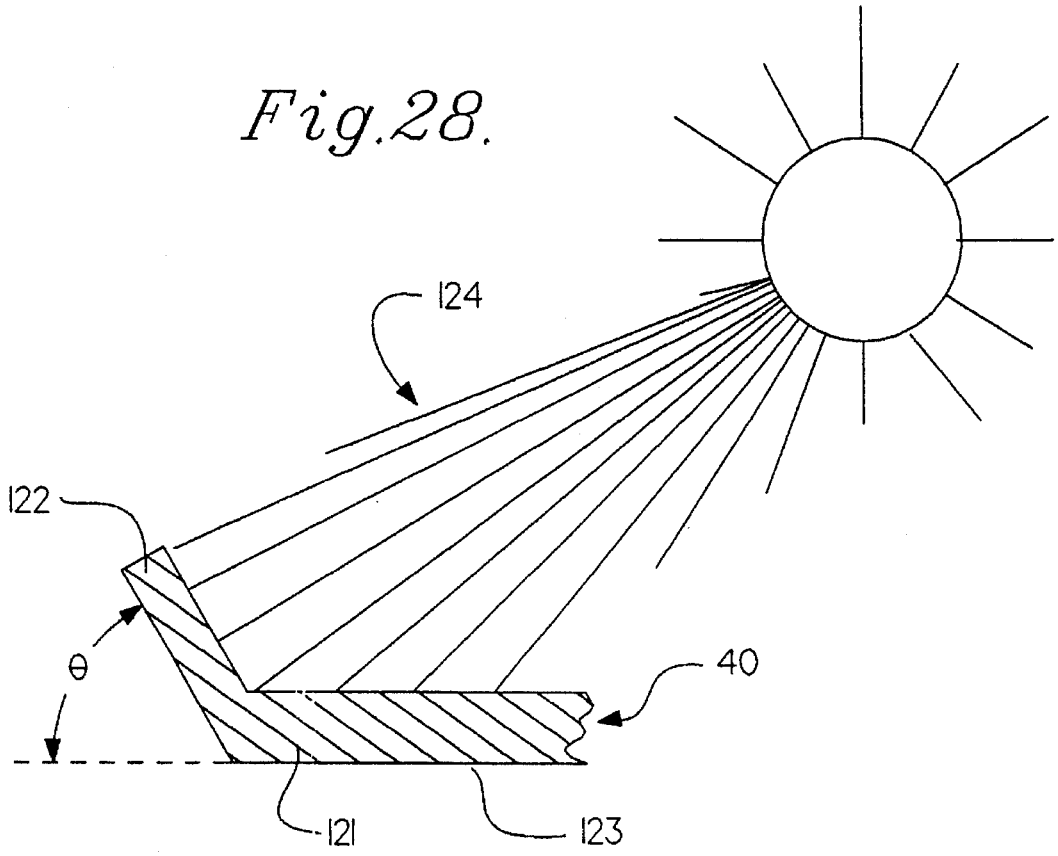
FIG. 28 is a sectional view of a portion of an edge of another embodiment of an angel figure similar to that in FIG. 23.

In still another embodiment of the present invention, shown in FIG. 28, outer edge 121 of figure 40, seen in cross-section, can have flange 122 which is disposed at a preselected angle θ from the axis parallel to the front surface 123 of figure 40. In this way, a portion of candle light 124 which would otherwise be lost is trapped by flange 122, thus augmenting the apparent brightness of outer edge 121.

Figure 29:
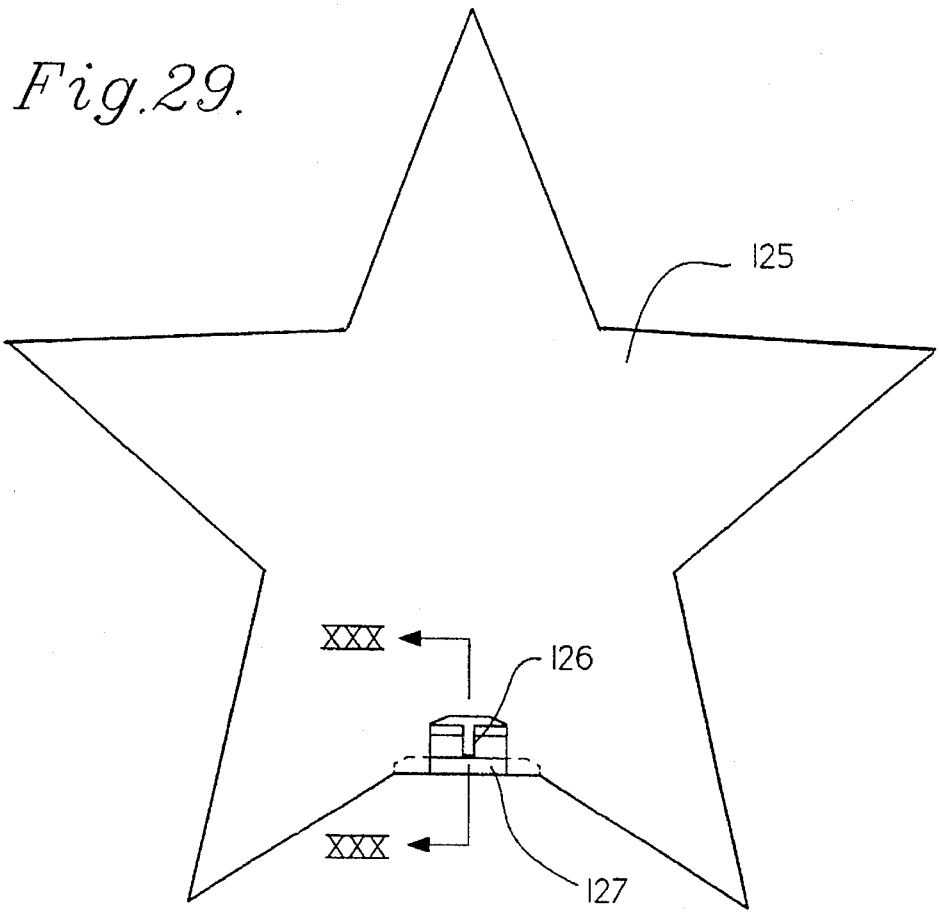
FIG. 29 is a front view of a star figure sized to be placed on the candle holder of FIGS. 19–22.
Figure 30:
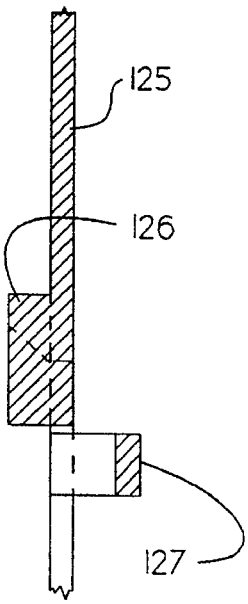
FIG. 30 is a cross-sectional view of a portion of the star in FIG. 29.
Figure 31:
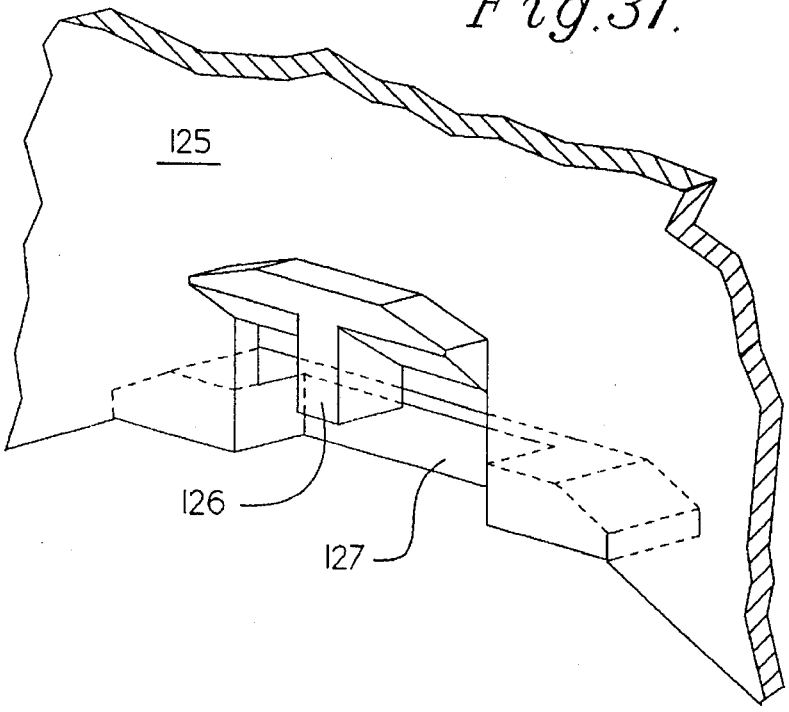
FIG. 31 is an exploded perspective view of a portion of the star figure shown in FIG. 29.

In another embodiment of the present invention, shown in FIGS. 29–31, star 125 is sized to accommodate the upright 4 of candle holder 1 in FIGS. 19–22. Star 125 has a prominence 126 which is sized and positioned to engage an opening such as opening 7 in support 6 shown in FIGS. 19–22. Retainer 127 is adapted to fit around support 6 shown in FIGS. 19–22.

As with the aforementioned angel, star 125 is preferably made of a transparent or translucent material so that light emitted from the candle placed on candle holder 1 will pass through the star and illuminate it.

Although we have illustrated and described present preferred embodiments of our candle holder it should be distinctly understood that our invention is not limited thereto, but may be variously embodied within the scope of the following claims.

We claim:

1. A candle holder comprising:

a base;

an upright attached to the base and adapted to receive a figure having a slot sized to fit over the upright, the upright shaped to permit attachment of at least one suction cup to the upright; and a candle support extending from the upright over the base and sized to engage a candle placed on the base and prevent the candle from falling from the base when the candle is subjected to forces acting on the candle in a direction parallel to the base, the candle support having an opening, the opening being adapted to receive a tongue which extends longitudinally in the slot of the figure wherein the opening and the tongue cooperate to restrain the figure from movement.

2. The holder of claim 1 wherein the base further comprises at least one pedestal, the pedestal having at least one groove, the at least one groove being sized and positioned to matably receive a lower portion of the figure to restrain the figure from movement.

3. The holder of claim 1 wherein the candle holder is comprised of a plastic selected from the group consisting of polypropylenes, polycarbonates, polyvinyl chloride, and styrenic resins.

4. The holder of claim 1 also comprising a plurality of suction cups removably attached to the upright.

5. The holder of claim 1 also comprising a retainer extending from at least one edge of the base and being sized and positioned to inhibit a candle placed on the base from sliding off the base.

6. The holder of claim 5 wherein the retainer is comprised of at least two segments.

7. The holder of claim 1 also comprising a pad on a surface of the base, the pad being sized and positioned for placement of a candle thereon.

8. The holder of claim 1 wherein light may pass through the upright.

9. The holder of claim 8 wherein the upright is translucent.

10. The holder of claim 1 also comprising a figure having a slot sized to engage the upright, the figure having a tongue extending longitudinally in the slot and the tongue engaging the opening in the candle support.

11. The holder of claim 10 wherein the figure has a shape customarily associated with a holiday.

12. The holder of claim 11 wherein the shape is selected from the group consisting of angels, bunnies, and stars.

13. The holder of claim 10 wherein the figure is sized so that a candle placed on the base will not extend above the figure.

14. The holder of claim 10 wherein the figure is sized and configured so as not to extend to the base.

15. The holder of claim 10 wherein the figure has a plurality of lineations on a side of the figure.

16. The holder of claim 15 wherein the lineations are oriented at a preselected angle with respect to a plane normal to the side.

17. The holder of claim 16 wherein the preselected angle is at least about 4°.

18. The holder of claim 15 wherein the lineations are spaced and sized to defract light from a candle placed on the candle holder.

19. The holder of claim 15 wherein the lineations are at least one of ribs and grooves.

20. The holder of claim 15 wherein the lineations are tapered towards the center of the figure such that a dimension of each of the lineations increases as the center is approached.

21. The holder of claim 10 wherein the figure has a plurality of lineations disposed radially from the center.

22. The holder of claim 10 wherein the figure includes a lens disposed on a side of the figure, the lens being positioned to transmit at least a portion of the light from the candle.

23. The holder of claim 22 wherein the lens is integrally molded into the figure.

24. The holder of claim 1 also comprising a figure which is permanently affixed to the upright.

* * * * *

UNITED STATES PATENT AND TRADEMARK OFFICE

CERTIFICATE OF CORRECTION

PATENT NO. : 5,601,272

DATED : February 11, 1997

INVENTOR(S) : WILLIAM E. ADAMS, WILLIAM RAFTERY

It is certified that error appears in the above-indentified patent and that said Letters Patent is hereby corrected as shown below:

On title page,

At [56] References Cited, Foreign Patent Documents, change "100685" to --100865--.

Signed and Sealed this

Seventeenth Day of June, 1997

Bruce Lehman

*Attest:*

BRUCE LEHMAN

*Attesting Officer*

*Commissioner of Patents and Trademarks*